US008322492B1

(12) United States Patent
Balzano

(10) Patent No.: US 8,322,492 B1
(45) Date of Patent: Dec. 4, 2012

(54) LADDER SYSTEM WITH INTEGRATED AIR BAGS AT BASE

(76) Inventor: John F. Balzano, Altoona, PA (US)

( * ) Notice: Subject to any disclaimer, the term of this patent is extended or adjusted under 35 U.S.C. 154(b) by 116 days.

(21) Appl. No.: 12/984,832

(22) Filed: Jan. 5, 2011

(51) Int. Cl.
*E06C 1/36* (2006.01)

(52) U.S. Cl. ..... 182/129; 182/137

(58) Field of Classification Search ..... 182/129, 182/137
See application file for complete search history.

(56) References Cited

U.S. PATENT DOCUMENTS

| | | | | |
|---|---|---|---|---|
| 3,088,542 | A * | 5/1963 | Johnson et al. | 182/48 |
| 3,848,698 | A * | 11/1974 | Kanbe | 182/83 |
| D295,222 | S | 4/1988 | Rudolph | |
| D296,940 | S | 7/1988 | Dawson | |
| 4,813,663 | A * | 3/1989 | Rice | 472/116 |
| 5,052,065 | A | 10/1991 | West | |
| 5,150,767 | A * | 9/1992 | Miller | 182/137 |
| 5,203,427 | A | 4/1993 | Williams, Sr. et al. | |
| 5,768,705 | A | 6/1998 | McCloud | |
| 6,386,576 | B1 | 5/2002 | Kamen et al. | |
| 2006/0254857 | A1 | 11/2006 | Zhou et al. | |
| 2008/0223653 | A1 * | 9/2008 | Kim et al. | 181/286 |

FOREIGN PATENT DOCUMENTS

WO WO 9413924 A1 * 6/1994

* cited by examiner

*Primary Examiner* — Alvin Chin Shue

(57) ABSTRACT

An airbag ladder system featuring a ladder and an airbag housing disposed on the side panel of the ladder at the bottom end. One or more airbags are temporarily housed in the airbag housing. When deployed, the airbags surrounds the bottom area of the ladder. Each airbag is connected to an inflation component, which functions to inflate the airbags when activated. The inflation component is operatively connected to a sensor. Latches are disposed along the side panel of the ladder. A tether extending from the airbag housing can be threaded through the latches as a user ascends the ladder. The tether is clipped to a user's clothing. The tether is connected to the sensor such that when the tether is pulled quickly if a user falls from the ladder the sensor activates the inflation component effectively inflating the airbags.

8 Claims, 3 Drawing Sheets

LADDER SYSTEM WITH INTEGRATED AIR BAGS AT BASE

FIELD OF THE INVENTION

The present invention is directed to a ladder, more particularly to a ladder with integrated air bags positioned at the base to cushion a user if he/she falls from the ladder.

BACKGROUND OF THE INVENTION

Ladders can be very dangerous, and many individuals have died from falling from a ladder. The present invention features a ladder system with integrated air bags, which can provide a soft surface if a user falls from the ladder. The ladder system of the present invention can help save lives, provide peace of mind to individuals who often use ladders, and may even help to lower a uses liability and worker compensation rates.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a ladder system with integrated airbags. In some embodiments, the ladder system comprises a ladder having a first side panel, a second side panel, and a plurality of rungs connecting the side panels together, the ladder has a top end and a bottom end; an airbag housing disposed on the first side panel at the bottom end of the ladder, the airbag housing functions to temporarily store a first airbag, a second airbag, and a third airbag, the first airbag when deployed out of the airbag housing extends outwardly from the bottom end of the ladder around the first side panel, the second airbag when deployed out of the airbag housing extends outwardly from the bottom end of the ladder around the second side panel, and the third airbag when deployed out of the airbag housing extends outwardly from the bottom end of the ladder in front of the rungs; an inflation component disposed in the airbag housing, the inflation component is operatively connected to each airbag and to a sensor, when the inflation component is activated the inflation component causes quick inflation of the airbags; a plurality of latches disposed along the first side panel of the ladder from the top end of the ladder to near the bottom end of the ladder, the latches each create a slot in between the respective latch and the first side panel of the ladder; and a tether extending out of the airbag housing, the tether is adapted to be threaded through the slots between the latches and the first side panel of the ladder, wherein a clip is disposed on a first end of the tether, the clip adapted to clip to a user's clothing, wherein a second end of the tether is operatively connected to the sensor in the airbag housing; wherein the sensor is adapted to detect if the tether is pulled quickly whereupon the sensor activates the inflation component causing the inflation component to quickly fill the airbags.

In some embodiments, the ladder is an A-frame ladder or an extension ladder. In some embodiments, the airbag housing is attached to the side panels or the rungs of the ladder via a mounting bracket, a mounting strap, an adhesive, a hook-and-loop fastener mechanism, a magnet mechanism, or a combination thereof. In some embodiments, the airbag housing engages a housing slot disposed in the first side panel of the ladder. In some embodiments, the airbags are interconnected such that when the airbag system is activated all airbags inflate simultaneously. In some embodiments, the system comprises one airbag, two airbags, four airbags, five airbags, six airbags, or more than six airbags. In some embodiments, the latches are loops or partial loops. In some embodiments, the latches are pivotally attached to the first side panel of the ladder.

DESCRIPTION OF PREFERRED EMBODIMENTS

Figure 1:
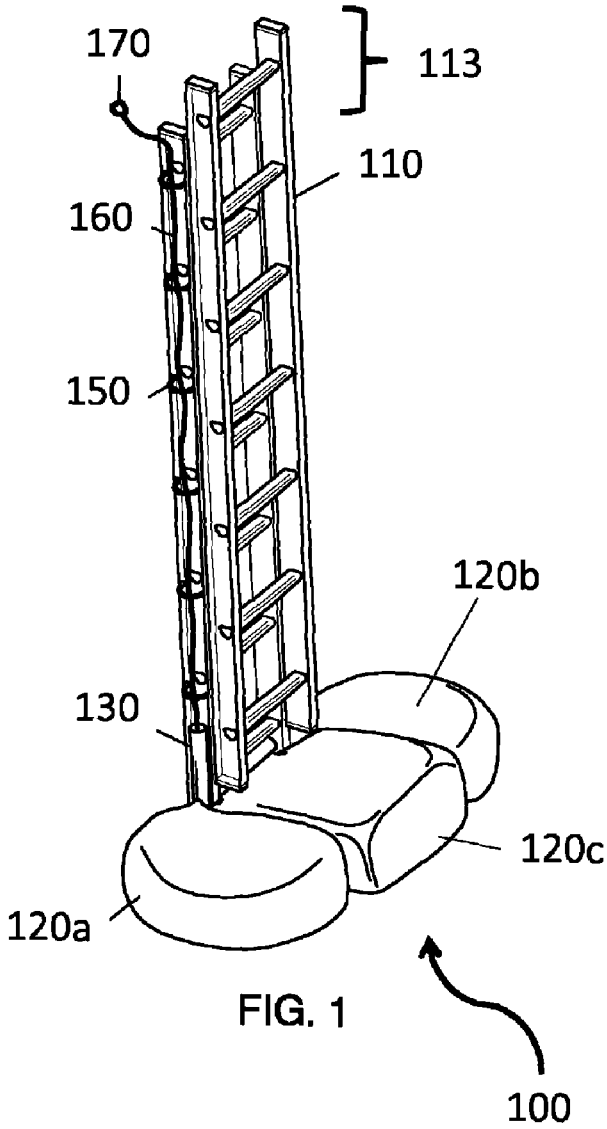
FIG. 1 is a perspective view of the ladder system of the present invention, wherein the airbags are deployed.

Referring now to FIGS. 1-6, the present invention features a ladder system 100 with integrated air bags, which can provide a soft surface if a user falls from the ladder.

The ladder system 100 of the present invention comprises a ladder 110. The ladder resembles standard ladders, which are well known to one of ordinary skill in the art. For example, in some embodiments, the ladder 110 is an extension ladder (e.g., see FIG. 1, FIG. 2). In some embodiments, the ladder is an A-frame ladder. The ladder 110 has two side panels (e.g., a first side panel 111, a second side panel 112) and a plurality of rungs 110*a* connecting the two side panels 111, 112 together. The ladder 110 has a top end 113 and a bottom end 114.

Disposed at the bottom end of the ladder 110 is an airbag system. The airbag system may comprise one or more airbags 120, for example a first airbag 120*a*, a second airbag 120*b*, and a third airbag 120*c* as shown in FIG. 1. The first airbag 120*a* may extend outwardly from the bottom end of the ladder 110 around the first side panel 111, the second airbag 120*b* may extend outwardly from the bottom end of the ladder 110 around the second side panel 112, and the third airbag 120*c* may extend outwardly from the bottom end of the ladder 110 around the front area (e.g., in front of the rungs 110*a*). The airbags 120 may be all interconnected so that when the airbag system is activated all airbags 120 inflate simultaneously. The present invention is not limited to three airbags. For example, in some embodiments, the airbag system comprises one airbag, two airbags, four airbags, five airbags, six airbags, or more than six airbags.

Figure 3:
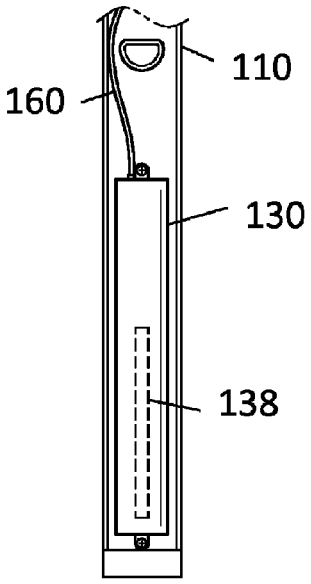
FIG. 3 is a side view of the ladder system of FIG. 2.
Figure 4:
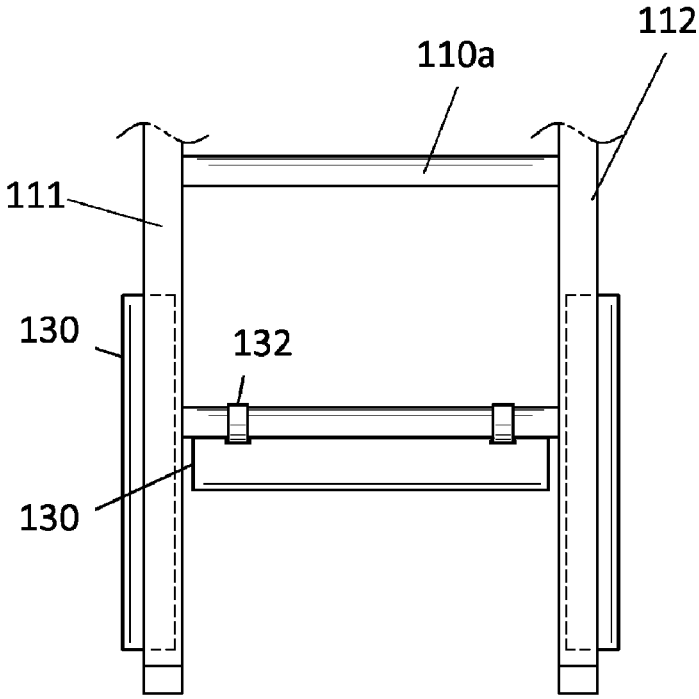
FIG. 4 is a front view of the ladder system of FIG. 2.

The airbags 120 when not deployed are stored in one or more airbag housings 130 disposed at the bottom end of the ladder 110. The airbag housings 130 may be attached (e.g., removably) to the side panels or the rungs of the ladder 110 via an attachment means, as shown in FIG. 3 and FIG. 4. In some embodiments, the attachment means includes a mounting bracket 134 (or clip), a mounting strap 132, an adhesive, a hook-and-loop fastener mechanism, a magnet mechanism, the like, or a combination thereof. In some embodiments, the airbag housings 130 engage a housing slot 138 disposed in the side panels of the ladder 110.

Figure 6:
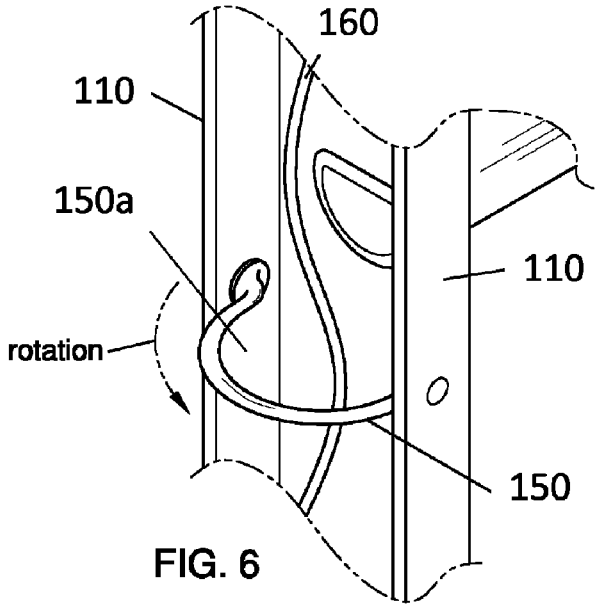
FIG. 6 is a detailed view of a latch and tether of the ladder system of the present invention.

A plurality of latches 150 (e.g., loops or partial loops) are disposed on the first side panel or the second side panel (or both side panels) of the ladder 110 extending from the top end of the ladder 110 to the bottom end of the ladder 110. FIG. 6 shows a detailed view of a latch attached to the first side panel of the ladder 110. The latches 150 create a slot 150*a* in between the latch 150 and the side panel of the ladder, allowing passage of a tether 160. In some embodiments, the latches 150 are pivotally attached to the side panel of the ladder. For example, FIG. 6 shows the latch 150 capable of being pivoted upwardly and downwardly.

Figure 2:
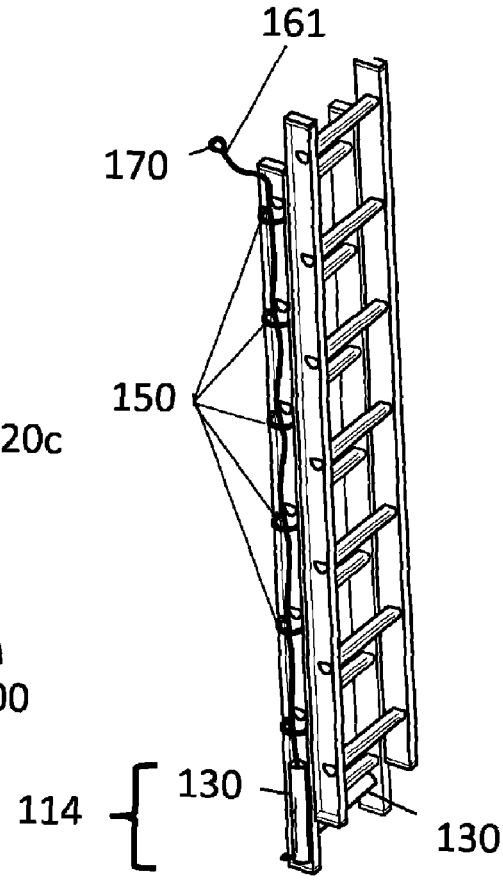
FIG. 2 is a perspective view of the ladder system of the present invention, wherein the airbags are not deployed.

The system 100 of the present invention further comprises a tether 160 that extends out of the airbag housing 130. The tether 160 is adapted to be threaded through the slots between the latches 150 and the side panel of the ladder, for example as shown in FIG. 1 and FIG. 2. Disposed on the first end 161 of the tether 160 is a clip 170. The clip 170 functions to clip the tether 160 to a user, for example his/her pants, etc. The clip 170 is not limited to a standard clip but may include other means of attaching the tether 160 to the user, for example a string (e.g., tie), a buckle, etc.

Figure 5:
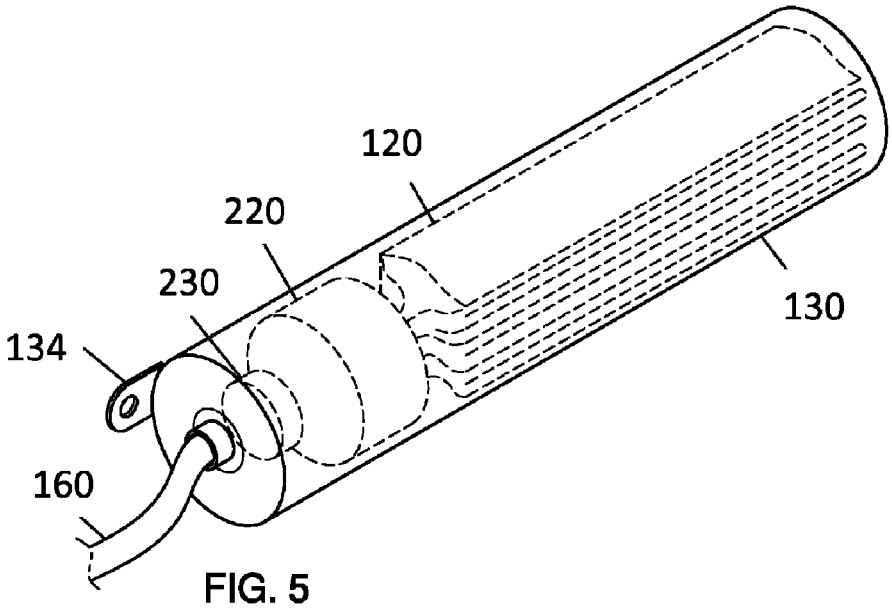
FIG. 5 is a detailed view of the airbag housing of the ladder system of the present invention.

FIG. 5 shows a detailed view of an airbag housing 130. The airbags 120 are each operatively connected to an inflation component 220, which functions to quickly inflate the airbags 120 when the inflation component is activated. The second end of the tether 160 is operatively connected to a sensor 230, which is operatively connected to the inflation component 220. The sensor 230 is adapted to detect if the tether is 160 pulled quickly, which would occur if a user was falling from the ladder 110. When the sensor 230 detects the tether 160 is pulled quickly, the sensor 230 activates the inflation component 220 causing the inflation component 220 to quickly fill the airbags 120.

To use the system 100 of the present invention, a user clips the tether 160 to his/her body via the clip 170. The user must feed the tether 160 through the plurality of latches 150 by clipping and unclipping the tether 160. When he/she is at the top of the ladder 110, the user completes his/her work. If he/she should fall, the tether 160 would be pulled quickly, causing the sensor 230 to activate the inflation components 220 to inflate the airbags 120 below the ladder (e.g., see FIG. 1). The airbags 120 provide cushioning for the user to help soften the fall. If the user completes his/her work and does not fall, he/she must feed the tether back through the latches 150 by clipping and unclipping the tether 160 from his/her body.

In some embodiments, for example in an alternative version of the system 100 of the present invention, a frame (e.g., rectangular frame) with airbags may surround the base of the ladder. In some embodiments, the system of the present invention comprises an accelerometer for quick activation of the airbags if a user is falling.

The disclosures of the following U.S. patents are incorporated in their entirety by reference herein: U.S. Pat. Application No. 2006/0254857; U.S. Pat. No. 5,203,427; U.S. Pat. No. 5,768,705; U.S. Pat. No. 5,052,065; U.S. Pat. No. 6,386,576; U.S. Design Pat. No. D295,222; U.S. Design Pat No. D296,940.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A ladder system comprising:

(a) a ladder having a first side panel, a second side panel, and a plurality of rungs connecting the side panels, together, the ladder has a top end and a bottom end;

(b) an airbag housing disposed on the first side panel at the bottom end of the ladder, the airbag housing functions to temporarily store a first airbag, a second airbag, and a third airbag, the first airbag when deployed out of the airbag housing extends outwardly from the bottom end of the ladder around the first side panel, the second airbag when deployed out of the airbag housing extends outwardly from the bottom end of the ladder around the second side panel, and the third airbag when deployed out of the airbag housing extends outwardly from the bottom end of the ladder in front of the rungs;

(c) an inflation component disposed in the airbag housing, the inflation component is operatively connected to each airbag and to a sensor, when the inflation component is activated the inflation component causes quick inflation of the airbags;

(d) a plurality of latches disposed along the first side panel of the ladder from the top end of the ladder to near the bottom end of the ladder, the latches each create a slot in between the respective latch and the first side panel of the ladder; and (e) a tether extending out of the airbag housing, the tether is adapted to be threaded through the slots between the latches and the first side panel of the ladder, wherein a clip is disposed on a first end of the tether, the clip adapted to clip to a user's clothing, wherein a second end of the tether is operatively connected to the sensor in the airbag housing;

wherein the sensor is adapted to detect if the tether is pulled quickly whereupon the sensor activates the inflation component causing the inflation component to quickly fill the airbags.

2. The ladder system of claim 1, wherein the ladder is an A-frame ladder or an extension ladder.

3. The ladder system of claim 1, wherein the airbag housing is attached to the side panels of the ladder via a mounting bracket, a mounting strap, an adhesive, a hook-and-loop fastener mechanism, a magnet mechanism, or a combination thereof.

4. The ladder system of claim 1, wherein the airbag housing 130 engages a housing slot disposed in the first side panel of the ladder 110.

5. The ladder system of claim 1, wherein the airbags are interconnected such that when the airbag system is activated all airbags inflate simultaneously.

6. The ladder system of claim 1 comprising one airbag, two airbags, four airbags, five airbags, six airbags, or more than six airbags.

7. The ladder system of claim 1, wherein the latches are loops or partial loops.

8. The ladder system of claim 1, wherein the latches are pivotally attached to the first side panel of the ladder.

* * * * *